US010180297B2

(12) United States Patent
Post

(10) Patent No.: US 10,180,297 B2
(45) **Date of Patent: *Jan. 15, 2019**

(54) FIREARM MONITORING AND NOTIFICATION APPARATUS AND METHOD OF USE

(71) Applicant: Charles William Post, Centennial, CO (US)

(72) Inventor: Charles William Post, Centennial, CO (US)

(73) Assignee: Charles William Post, Centennial, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/917,999

(22) Filed: Mar. 12, 2018

(65) Prior Publication Data

US 2018/0202738 A1 Jul. 19, 2018

Related U.S. Application Data

(63) Continuation-in-part of application No. 15/222,819, filed on Aug. 18, 2016, now Pat. No. 9,945,630.

(51) Int. Cl.

| | |
|---|---|
| ***F41A 17/06*** | (2006.01) |
| ***F41A 23/18*** | (2006.01) |
| ***F41A 17/04*** | (2006.01) |

(52) U.S. Cl.

CPC ..... *F41A 17/063* (2013.01); *F41A 17/04* (2013.01); *F41A 23/18* (2013.01)

(58) Field of Classification Search

CPC ..... F41A 17/063; F41A 17/04; F41A 23/18; F41A 17/00; F41A 17/06; F41C 33/06

USPC ..... 42/70.06, 70.11

See application file for complete search history.

(56) References Cited

U.S. PATENT DOCUMENTS

| | | | | |
|---|---|---|---|---|
| 2,187,194 | A | 1/1940 | Champman | |
| 3,307,755 | A * | 3/1967 | Lentz | F41C 33/06 206/317 |
| 3,419,728 | A * | 12/1968 | Wilson | B60R 7/14 211/4 |
| 4,299,045 | A | 11/1981 | Cervantes | |
| 4,499,681 | A * | 2/1985 | Bako | E05B 37/025 42/70.07 |
| 4,509,281 | A | 4/1985 | Dreiling et al. | |
| 4,768,021 | A * | 8/1988 | Ferraro | E05G 1/005 109/38 |
| 5,168,994 | A | 12/1992 | Beletsky | |
| 5,196,827 | A | 3/1993 | Allen | |
| 5,282,539 | A * | 2/1994 | Saathoff | A47B 81/005 211/4 |
| 5,309,661 | A * | 5/1994 | Fuller | F41A 17/54 42/70.07 |
| 5,392,552 | A * | 2/1995 | McCarthy | F41A 17/54 42/70.06 |
| 5,417,000 | A | 5/1995 | Chen | |
| 5,450,684 | A | 9/1995 | Harris | |

(Continued)

*Primary Examiner* — Joshua E Freeman
(74) *Attorney, Agent, or Firm* — Voz Patents, LLC

(57) ABSTRACT

The present disclosure provides a firearm monitoring and notification apparatus to allow users to monitor a firearm without interfering with the accessibility to the firearm. The firearm monitoring and notification apparatus mitigates common risks surrounding unauthorized access and tampering through deterrence and notification strategies.

16 Claims, 18 Drawing Sheets

(56) References Cited

U.S. PATENT DOCUMENTS 5,487,234 A * 1/1996 Dragon ..... F41A 17/06 340/571
5,561,935 A * 10/1996 McCarthy ..... F41A 17/54 42/70.07
5,579,923 A * 12/1996 Hemmerlein ..... A47B 81/005 211/4
5,621,996 A * 4/1997 Mowl, Jr. ..... F41A 23/18 211/64
5,647,158 A * 7/1997 Eskelinen ..... F41A 17/54 42/70.06
5,680,723 A * 10/1997 Ruiz ..... F41A 17/44 42/70.07
5,701,770 A * 12/1997 Cook ..... E05B 47/02 206/1.5
6,009,654 A * 1/2000 Williams ..... F41C 33/06 206/317
6,142,313 A * 11/2000 Young ..... F41A 17/02 211/4
6,260,300 B1 * 7/2001 Klebes ..... F41A 17/066 206/317
6,301,815 B1 * 10/2001 Sliwa ..... F41A 17/066 42/70.01
6,330,615 B1 12/2001 Duncan
6,408,555 B1 6/2002 Sepia
6,474,238 B1 11/2002 Weinraub
6,488,148 B1 12/2002 Woodson
6,523,374 B1 2/2003 Owens
6,568,116 B2 * 5/2003 Hathaway ..... F41A 17/06 211/64
6,718,678 B2 4/2004 Riebling et al.
6,823,621 B2 * 11/2004 Gotfried ..... F41A 17/066 42/70.01
6,843,081 B1 * 1/2005 Painter ..... F41C 33/06 109/45
6,845,640 B2 * 1/2005 Loeff ..... E05B 53/003 109/45
7,116,224 B2 10/2006 Mickler
7,281,397 B2 10/2007 Victor
7,367,150 B2 5/2008 Farchione et al.
7,584,566 B2 * 9/2009 Victor ..... F41A 17/02 42/70.06
8,653,974 B2 2/2014 Crook
8,819,979 B2 9/2014 Kelly
8,893,420 B2 * 11/2014 Milde, Jr. ..... F41A 35/00 42/70.04
8,919,024 B2 * 12/2014 Milde, Jr. ..... F41A 17/066 42/70.01
9,261,326 B1 * 2/2016 Chandler ..... F41A 23/18
9,303,935 B2 * 4/2016 Milde, Jr. ..... F41A 17/066
9,441,911 B2 * 9/2016 Pikielny ..... F41A 17/44
9,448,025 B2 * 9/2016 Farr ..... F41A 17/54
9,488,427 B1 * 11/2016 Lucero ..... F41A 17/54
9,530,266 B2 * 12/2016 Delattre ..... E05G 1/005
9,618,287 B2 4/2017 Milde
2002/0032976 A1 3/2002 Riener
2006/0112605 A1 * 6/2006 Sopko ..... F41A 17/54 42/70.11
2007/0180748 A1 8/2007 Zemanek
2007/0180749 A1 * 8/2007 Schumacher ..... F41A 17/063 42/70.01
2008/0034635 A1 2/2008 Victor
2012/0062388 A1 * 3/2012 Wilson ..... G06Q 10/0833 340/686.6
2013/0335223 A1 12/2013 Brown et al.
2014/0159899 A1 6/2014 Crook
2015/0040453 A1 * 2/2015 Ballard ..... F41A 17/066 42/70.11
2015/0260480 A1 * 9/2015 Dunn ..... F41C 33/06 42/70.11
2016/0377362 A1 * 12/2016 Farr ..... F41A 17/04 42/70.06
2017/0067709 A1 * 3/2017 Post ..... F41A 17/063

* cited by examiner

FIREARM MONITORING AND NOTIFICATION APPARATUS AND METHOD OF USE

This application is a Continuation In Part Application of U.S. patent application Ser. No. 15/222,819, entitled "Firearm Monitoring and Notification Apparatus and Method of Use", filed Aug. 18, 2016, currently pending, which claims priority to U.S. Provisional Patent Application No. 62/198,610 entitled "Firearm Monitoring and Notification Apparatus" filed Jul. 29, 2015. The entire disclosures of the above-referenced applications are incorporated herein by reference in their entirety for all purposes.

FIELD OF THE INVENTION

The present invention relates to a firearm monitoring and notification apparatus providing active monitoring and notification of firearm safety status while mitigating increases time for an authorized user to access the firearm.

BACKGROUND OF THE INVENTION

The field surrounding firearm safety has for years proposed variations of a similar formula for accessibility of firearms, particularly in a firearm owner's home where children are present. Firearm owners that are also parents are met with the problem of securing his or her firearm to mitigate the risk of children having access while still allowing rapid access for scenarios such as a home invader.

In a life-threatening event such as a home invasion, rapid access to one's firearm may determine between life and death. When attempting to retrieve a firearm, the longer the time required to access to the firearm, the higher the potential for undesirable outcomes such as suffering physical harm at the hands of a home invader. An owner retrieving his or her firearm must arrive at the secured firearm, disengage a locking mechanism and in some cases remove the locking device from the firearm prior to use. When attempting to retrieve a firearm, an increase in time needed to access the firearm may result in an increase in the chance of undesirable outcome.

SUMMARY OF THE INVENTION

A commonly used solution of retaining a firearm and/or firing mechanism of a firearm uses a locking mechanism to secure the firearm from unauthorized access. However, the locking of a firearm often causes increased access time to the firearm. Some locking mechanisms consist of a safe or vault. Other locking mechanisms include cable-locks secured in position after being threaded through the barrel of the firearm or a trigger lock preventing the actuation of the trigger. The problem with these solutions surrounds concerns of home defense and rapid accessibility to the firearm. The act of disengaging a locking mechanism increases the access time to the firearm and may increase the chances of an undesirable outcome.

Some firearm retention solutions use a keyed locking mechanism to secure the firearm prior to use. Keyed connections are problematic as keys are often misplaced or can be discovered by unauthorized users, such as children. In a scenario where a firearm owner awakes to the sounds of a potential intruder in the middle of the night, the act of finding, orienting and inserting a key into a lock further compounds the problem of rapid access to a firearm for protection.

Some existing solutions for the securing of firearms use combination locks. Combination locks of a mechanical or electronic type may mitigate the possibility of searching for a key when the necessity for the firearm arises. However, a combination lock requires memory recall and dexterity. High-stress situations, which induce a fight-or-flight response, are known to have negative effects on cognitive ability and dexterity. As cognitive ability and dexterity deteriorates, this directly affects one's ability to access a firearm through the entry of a combination. An additional complication surrounding combination locks, particularly of the electronic type, is the potential loss of electrical power supplied to the unit preventing access to a firearm. Loss of household power, disconnection of wired power or depletion of battery may prevent the user from accessing his or her firearm.

Some existing solutions utilize biometric scanning technology, such as fingerprint scanning technology. However, such locking mechanisms share similar complications with electronic locks as the loss of power renders the biometric recognition system inoperable. Furthermore, in the event an authorized user of a firearm owner is incapacitated or cannot reach the locking mechanism, individuals such as a family member or friend cannot access the firearm unless his or her biometric data has been pre-programmed as an authorized user.

A solution that many firearm owners have adopted due to the problems surrounding locking mechanisms is to not employ any safety solution or apparatus at all. This solution poses increased risk, particularly in households with children, of unauthorized use of a firearm.

Some have concluded that the use of a locking mechanism hinders a firearm owner or authorized user to access the firearm, when rapid access is desired and have devised solutions in light of this finding. For example, U.S. Pat. No. 8,653,974, to Crook et al. ("Crook"), incorporated in its entirety by reference, discloses and claims a monitoring system that uses of an electronic system having an elongated flexible strap intended to pass through the trigger guard of the weapon and interface with an associated sensor to deter access by a non-authorized user. To remove the firearm, the sensor connection/strap connection must be interrupted to indicate removal of the firearm. The invention also discloses a keyed bypass system to allow an authorized user with a key-code to bypass systems described as the deployment sensor switch, base tamper switch and magnetic tamper switches. Even without a key-code to bypass these sensor devices, any user may still have full access to the firearm; however, this will set off an alarm notifying an authorized user of the removal of the firearm from the apparatus. This places the unit into an alarm state providing monitoring information or alarm notification.

Where the Crook reference falls short surrounds the elongated flexible strap. Although a strap provides a level of access control and deters tampering by unauthorized users, the firearm is prone to tampering while still retained by the monitoring system. An unauthorized user may, without removal of the firearm from the monitoring system and without tripping a tamper-sensing alarm, actuate the trigger of the firearm and discharge the firearm. This causes a very dangerous and potentially lethal problem with little or no evidence of tampering until the firearm has been fired. An additional shortfall of the Crook reference surrounds the removal of the firearm from the monitoring system. Removing a firearm in a hasty manner from the monitoring system, as disclosed by Crook, may inadvertently discharge the firearm as the elongated flexible strap may actuate the trigger.

The present disclosure provides a firearm monitoring and notification apparatus to allow users to monitor a firearm without interfering with the accessibility to the firearm. The firearm monitoring and notification apparatus mitigates common risks surrounding unauthorized access and tampering through deterrence and notification strategies. A mitigation strategy of such a firearm monitoring and notification apparatus surrounds delivering notification to an authorized user when a tampering event is detected. Furthermore, certain embodiments of the apparatus as disclosed mitigate accidental or unauthorized discharge by preventing the actuation of the trigger prior to the detection of a tampering event. Embodiments of the present disclosure describe an apparatus that allows rapid access to a firearm while monitoring for unauthorized access and tampering events. It will be appreciated that a tampering event surrounds the attempted access, removal, or movement of a firearm by an unauthorized user.

It is an aspect of the present invention to allow a user rapid access to a firearm through the use of post and cap elements. The post and cap elements allow the securing of the firearm while mitigating the chances of accidental, unintentional or unauthorized firing of the firearm. In certain embodiments, access to the trigger is obscured by the cap, and in certain embodiments, the post prevents the actuation of the trigger when the firearm is disposed upon an apparatus of the present invention.

It is a further aspect of the present invention to notify a user of potential tampering events through the use of a notification system. The notification system of certain embodiments provides notification to a user to alert the user to such events as the movement of the cap in relation to the post, incorrect combination entry, or removal of the cap from the post. Notifications are provided by means of auditory signal, electronic notifications such as to a user's mobile device, notification to local law enforcement or home security providers. Notifications of certain embodiments are provided via wireless signal to devices such as cellular phones or connected devices associated with smarthome or Internet of Things (IoT) systems. Certain embodiments of the present invention provide notifications to the user through the use of an internet connected network or software.

BRIEF DESCRIPTION OF THE DRAWINGS

FIG. 13B—A bottom view of an embodiment of a cap.

FIG. 13C—A cross section view of a cap element and zoomed view of the engagement between a cap element and a post element.

FIG. 13D—A cross section view of a cap element and zoomed view of the engagement between a cap element and a post element.

FIG. 13E—A cross section view of a cap element and zoomed view of the engagement between a cap element and a post element.

FIG. 14B—A bottom view of an embodiment of a firearm monitoring and notification apparatus with a component door removed.

DETAILED DESCRIPTION

Figure 1A:
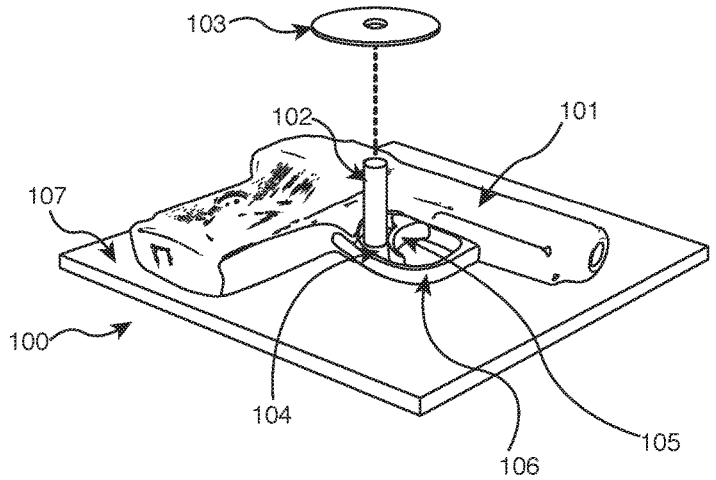
FIG. 1A—A certain embodiment demonstrating a firearm monitoring and notification apparatus exhibiting an assembly of a post and cap FIG. 1B—A certain embodiment demonstrating a firearm monitoring and notification apparatus exhibiting an assembly of a post and cap FIG. 2—A certain embodiment of a firearm FIG. 3—A certain embodiment of a firearm monitoring and notification apparatus in conjunction with a firearm exhibiting little or no gap between the proximal end of the trigger and the trigger guard FIG. 4A—An embodiment of assembly of a post and cap wherein the post is integrated into a surface of the apparatus and an orifice in the cap interfaces with the post element FIG. 4B—An embodiment of the post element comprising an open circuit, further comprising of at least two independent conductive surfaces FIG. 5—An embodiment of the invention demonstrating the use of the assembly of a post and cap in conjunction with a firearm FIG. 6A—A block diagram of an electrical system comprising the controlling system of a firearm monitoring and notification apparatus FIG. 6B—An embodiment of the comparator circuit in relation to a cap element uninstalled to a post element FIG. 6C—An embodiment of the comparator circuit in relation to a cap element installed to a post element FIG. 7—An embodiment of the invention demonstrating the use of the assembly of a post and cap and constraining features in conjunction with a firearm FIG. 8—A block diagram of an electrical system comprising the controlling system of a firearm monitoring and notification apparatus FIG. 9A—An embodiment of a firearm monitoring and notification apparatus in conjunction with a firearm larger than the surface of the apparatus FIG. 9B—An embodiment of a firearm monitoring and notification apparatus demonstrating scalability of the apparatus.
Figure 1B:
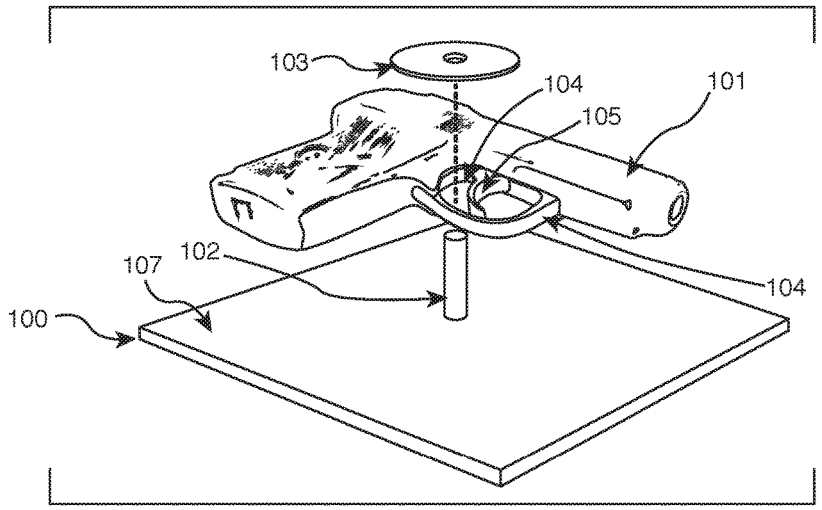

As seen in FIG. 1A and FIG. 1B, certain embodiments support access control through the use of post 102 and cap 103. The post 102, attached to a top surface 107 of the apparatus 101, passes through an aperture 104 created by features of a firearm 101. The aperture 104 comprises a space between a trigger 105 and a trigger guard 106 on the proximal or distal side of the trigger 105. It will be appreciated that, in reference to a firearm 101, as shown in in FIG. 2 the proximal end when held by a user, is closest to the user while the distal end is the portion of the firearm oriented away from the user and toward an intended target.

Certain embodiments of a firearm monitoring and notification apparatus, seen in FIG. 1A and FIG. 1B, comprise a post 102 for the disposal through an aperture 104 between a proximal portion of a trigger 105 and a proximal portion of a trigger guard 106 of a firearm 101. The presence of the post through the aperture 104 of the firearm 101 prevents the actuation of the trigger 105 prior to the removal of the firearm 101 from the post 102. Furthermore, a cap 103 is engaged with a post 102, blocking access to the trigger 105. The cap 103, blocks access to the trigger 105, preventing actuation of the trigger 105 prior to the removal of the cap 103 from the post 102.

Certain firearms 101 (seen in FIG. 3) as used in conjunction with certain embodiments of a firearm monitoring and notification apparatus 100 may not comprise an aperture between a proximal portion of a trigger 105 and a proximal portion of a trigger guard 106. It will be appreciated that a post 102 may pass through an aperture 104 defined by a distal portion of the trigger guard 106 and the distal portion of the trigger 105. In such embodiments, a cap 103 affixes to the post 102 to prevent access to the trigger 105 of the firearm 101, preventing the accidental or unauthorized actuation of the trigger 105 prior to the removal of the cap 103.

Figure 2:
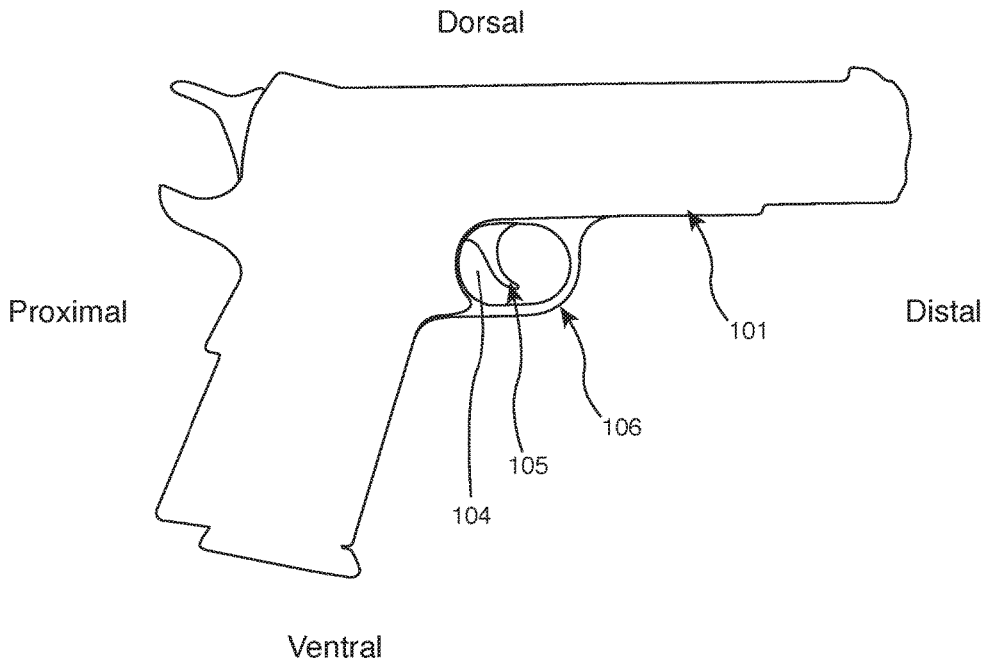
Figure 4A:
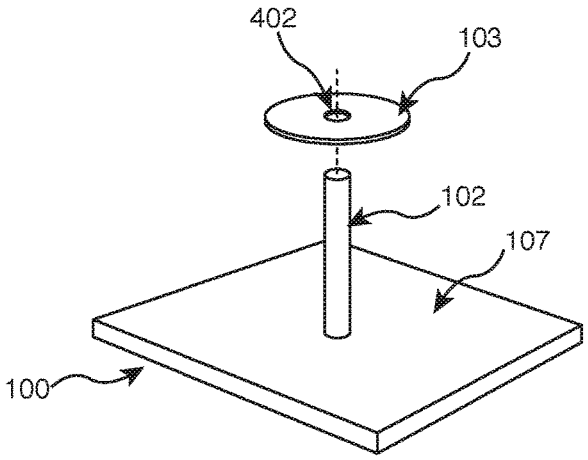

Certain embodiments, as shown in FIG. 4A, of a firearm monitoring and notification apparatus comprise a post 102 integrated into a top surface 107 of the firearm monitoring and notification apparatus 100 wherein the firearm 101 is placed on the top surface 107 such that the post 102 passes through the trigger guard 106 and preferably through an aperture 104 as shown in FIG. 2. The cap 103 is assembled to the post 102, closing a circuit to enable electric monitoring systems. The electronic monitoring systems identify electrical circuit characteristics including, open or completed circuit status, resistance values and/or other electrical characteristics commonly associated electrical circuit monitoring.

Figure 4B:
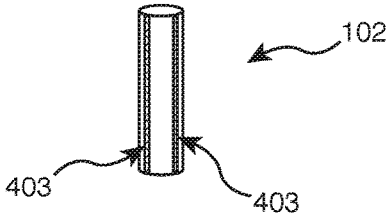

Certain embodiments of a firearm monitoring and notification apparatus 100 comprise a post 102 and cap 103 that interconnect to complete an electrical circuit. The variable resistance of the electrical circuit exhibits a change in voltage and/or resistance when the position of the cap 103 is changed with respect to the post 102. In certain embodiments, as seen in FIG. 4A and FIG. 4B, the post 102 exhibits at least two electrically separate conductors 403. The cap 103 has an orifice 402 having a perimeter comprising electrically conductive material. The orifice 402 is configured to mate with the post 102 such that the orifice 402 electrically bridges the conductors 403 and closes the electrical circuit. It will be appreciated by those skilled in the art that the assembly between the electrically conductive orifice 402 and the electrically separate conductors 403, comprises electrical characteristics with variable resistance, commonly referred to as a potentiometer, and the measured resistance at any given point across this circuit varies with the location of the cap 103 along the post 102.

Figure 5:
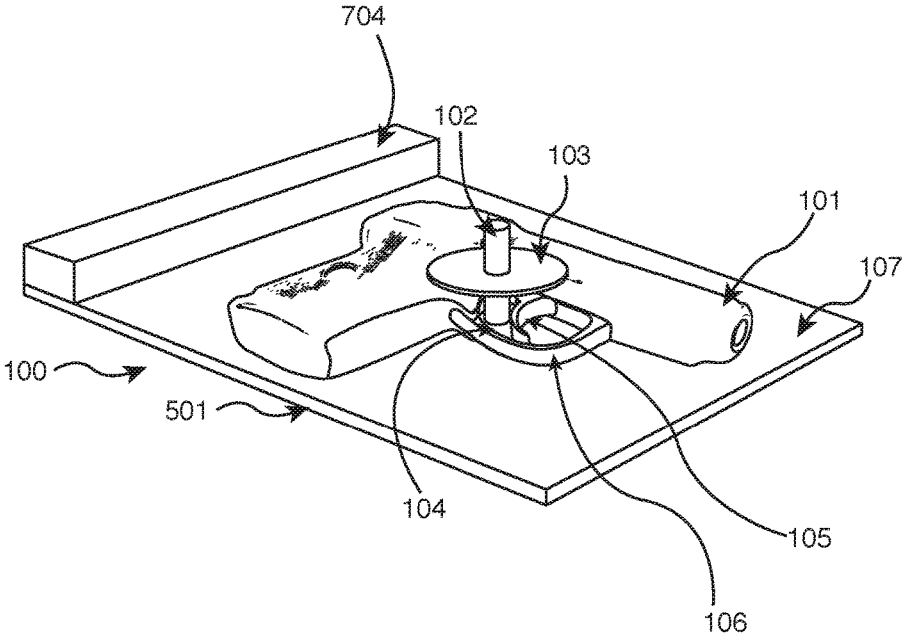
Figure 6A:
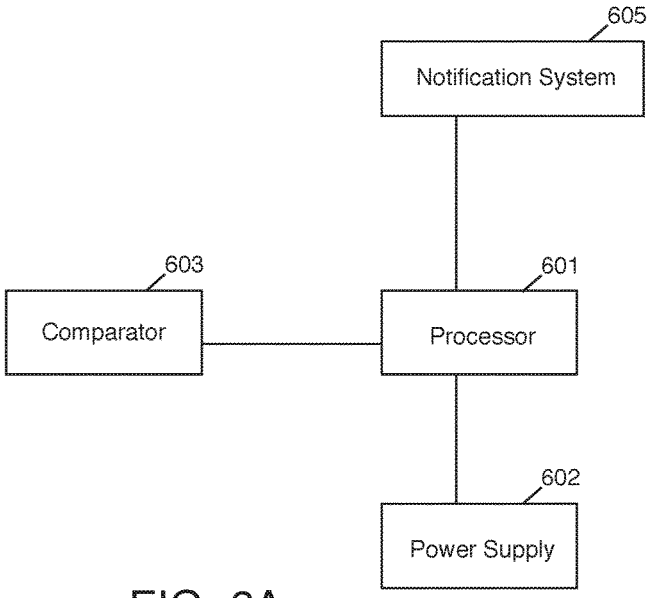

Certain embodiments, as shown in FIG. 5 and FIG. 6A, of the present invention comprise a base platform 501, a post 102, a cap 103, a processor 601, a power supply 602, a comparator 603 and a housing 704. The housing 704, in such embodiments, comprises a box-like form of width 7.62 cm (3 inches), height 5.08 cm (2 inches) and length at least equivalent to the dimension between the dorsal and ventral extents of a firearm 101. In such embodiments, ancillary components comprising the processor 601, and comparator 603 are contained within the housing 704. The base platform 501 typically has a rectangular form with width at least equal to the distance between the ventral and dorsal extents of the firearm 101. The base platform 501 typically has a rectangular form with length at least equal to the distance between the proximal to distal extents of the firearm 101. The base platform 501 further comprises a thin platform typically of thickness of 12.7 mm (0.5 inches) or less. Such embodiments of the apparatus 100 provides a low profile allowing the discrete use of the invention in existing spaces, such as within a drawer of a dresser or nightstand.

In certain embodiments of a firearm monitoring and notification apparatus, seen in FIG. 5, a firearm 101 may be placed on a top surface 107 with a post 102 passing through an aperture within the trigger guard 106—preferably the aperture 104 between the proximal side of the trigger 105 and the proximal portion of the trigger guard 106. Once the firearm 101 rests on the top surface 107 of the apparatus 100, as defined by the top surface of the platform 105, the cap 103 is installed. The cap 103 is installed by mating the orifice 402, configured to interface slidably along the longitudinal axis of the post 102, completing a variable resistance electrical circuit 604, seen in FIG. 6B and FIG. 6C. The user slidably engages the post 102 with the cap 103 and positions the cap 103 in close proximity to or in direct contact with the firearm 101, blocking access to the trigger 105. When the variable resistance circuit 604 is completed, a processor 601 records a baseline position of the post 102 and cap 103 by measuring circuit resistance. The processor continuously measures the resistance of the circuit on predetermined intervals, and determines if there is a change in resistance by using a comparator 603. If the assembly of a post 102 and cap 103 is disturbed from the originally installed position, the comparator 603 indicates such a change and the processor 601 records the event. The processor 601 may then provide an alarm or notification in response notifying the tampering of or removal of the firearm. These alarms or notifications may be executed through the use of auditory, visual or electronic communication through a notification system 605.

Figure 6B:
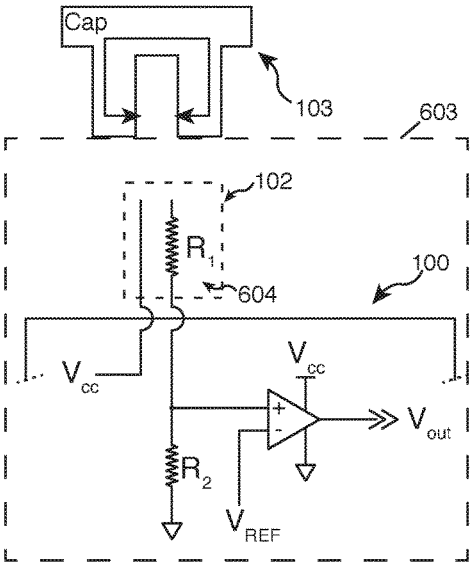
Figure 6C:
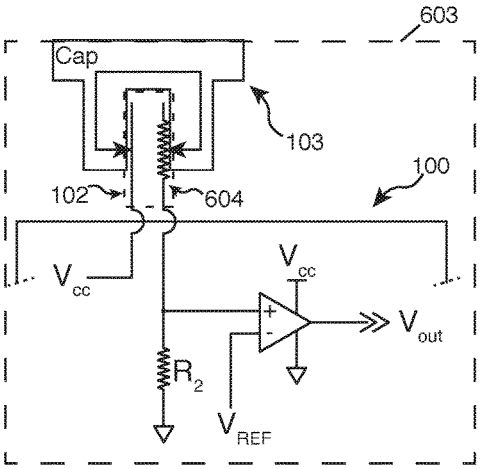

As seen in FIG. 6B and FIG. 6C, it will be appreciated by those skilled in the art that sensing the position or movement of a cap 103 may include but is not limited to the use of a comparator 603 in the form of an electrical circuit, used in conjunction with a processor 601 as shown in FIG. 6A. Other embodiments may exhibit circuits using variable resistors, hall effect sensors, piezokinetic, variable voltage or other strategies known to those in the art to provide an electrical signal. This electrical signal may indicate the status of a circuit. In certain embodiments, the processor 601 further comprises comparator functionality. The signals typically used in such systems are within a 0-12V DC range and more preferably within a 0-5V DC range.

Certain embodiments of a firearm monitoring and notification firearm monitoring and notification apparatus 100 comprise a comparator circuit 603 as seen in FIG. 6A and FIG. 6B. A cap 103 completes a comparator 603 in circuit form, comprising resistors and an operational amplifier. The comparator 603 detects change in circuit status—open versus closed—and resistance change to provide a voltage-based signal the processor 601.

Figure 3:
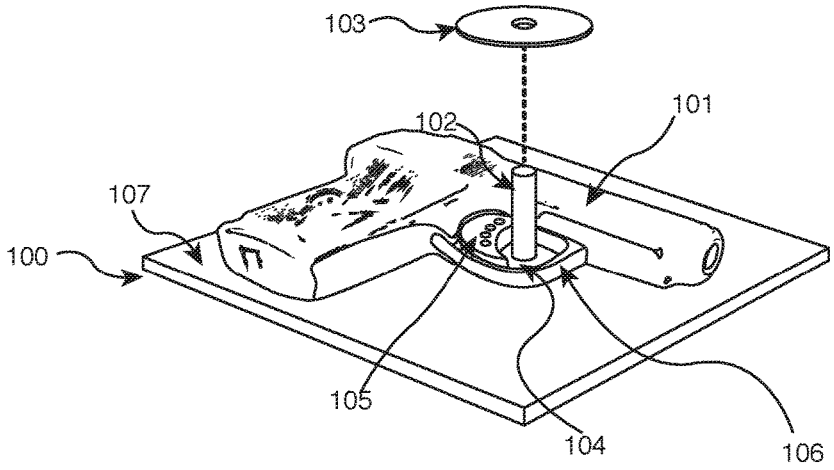
Figure 7:
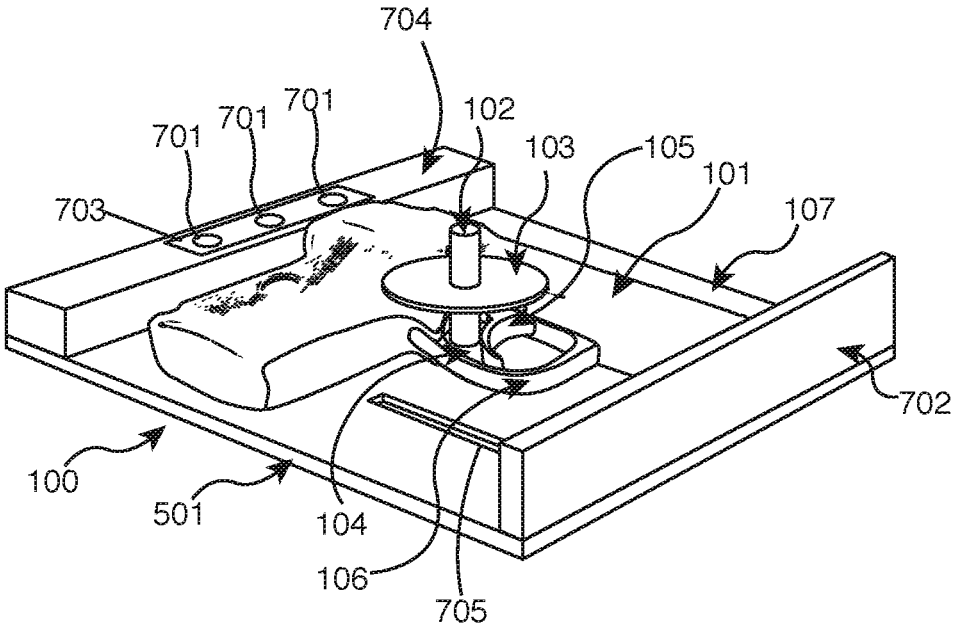

Certain embodiments of a firearm monitoring and notification apparatus, as seen in FIG. 6A and FIG. 7, a firearm monitoring and notification apparatus 100, comprising a base platform 501 with integrated post 102, power supply 602, processor 601 and comparator 603, further comprises a user interface panel 703. The user interface panel 703 further comprises a plurality of push-buttons 701 allowing for the preprogramming and user-input of a combination for positive identification of an authorized user. Certain embodiments further comprise a constraining element 702, configured to contact or be in close proximity of the distal end of the firearm 101. The constraining element 702 minimizes lateral movement of the firearm 101 mitigating risk of unintentional or unauthorized discharge of the firearm while retained by the firearm monitoring and notification apparatus 100. As shown, the constraining element 702 comprises a planar element extending orthogonally outward from the top surface 107 of the base-platform 501. Such embodiments of a constraining element are slidably adjustable along the length of a firearm monitoring and notification apparatus 100. Slidable adjustability allows the adjustment of the constraining element 702 in a proximal or distal direction until the constraining element 702 contacts or is in close proximity to the distal end of the firearm 101. In embodiments of a firearm monitoring and notification apparatus 100, the use of a constraining element 702 the may prevent the accidental or unauthorized actuation of a trigger 105 of a secured firearm 101 in configurations where a post 102 extends through an aperture 104 on the distal side of the trigger 105, such as in use with a firearm as seen in FIG. 3.

Once again referencing FIG. 7, alternative embodiments of a constraining element 702 may comprise, but are not limited to, post-like elements, a multi-planar element extending away from the base-platform 501, or other structures preventing or minimizing lateral movement of a firearm 101 retained by a firearm monitoring and notification firearm monitoring and notification apparatus 100. It will be appreciated that a constraining element 702 may contact or be in close proximity to a distal facing surface of the firearm. The adjustment of the constraining element 702 to contact the distal end of the firearm 101 prevents the actuation of the trigger 105 including in a scenario where a post 102 extends through an aperture on the distal side of the trigger 105.

In certain embodiments of the invention as seen in FIG. 6A and FIG. 7, a user places a firearm 101 on a firearm monitoring and notification apparatus 100 such that a post 102 extends through an aperture 104 of the firearm 101. A cap 103 is then slidably mated with the post 102 in order to activate the firearm monitoring and notification apparatus 100 monitoring capability. When a user wishes to remove the firearm 101, the user may input the proper combination via the push-buttons 701 to disarm the firearm monitoring and notification apparatus 100 prior to disturbing the cap 103. The pre-entering of the proper combination prevents the processor 601 from entering an alarm mode. The alarm mode, as toggled by the processor 601, activates an audible alarm and/or electronic notification through a notification system 605. The notification system 605 alerts the owner and/or other authorized users of the firearm 101 to potential tampering or removal of the firearm 101. Furthermore, an alarm state may also indicate the hasty removal of the firearm 101 by an authorized user, which may indicate the possibility of an emergency situation needing attention from authorities.

Figure 8:
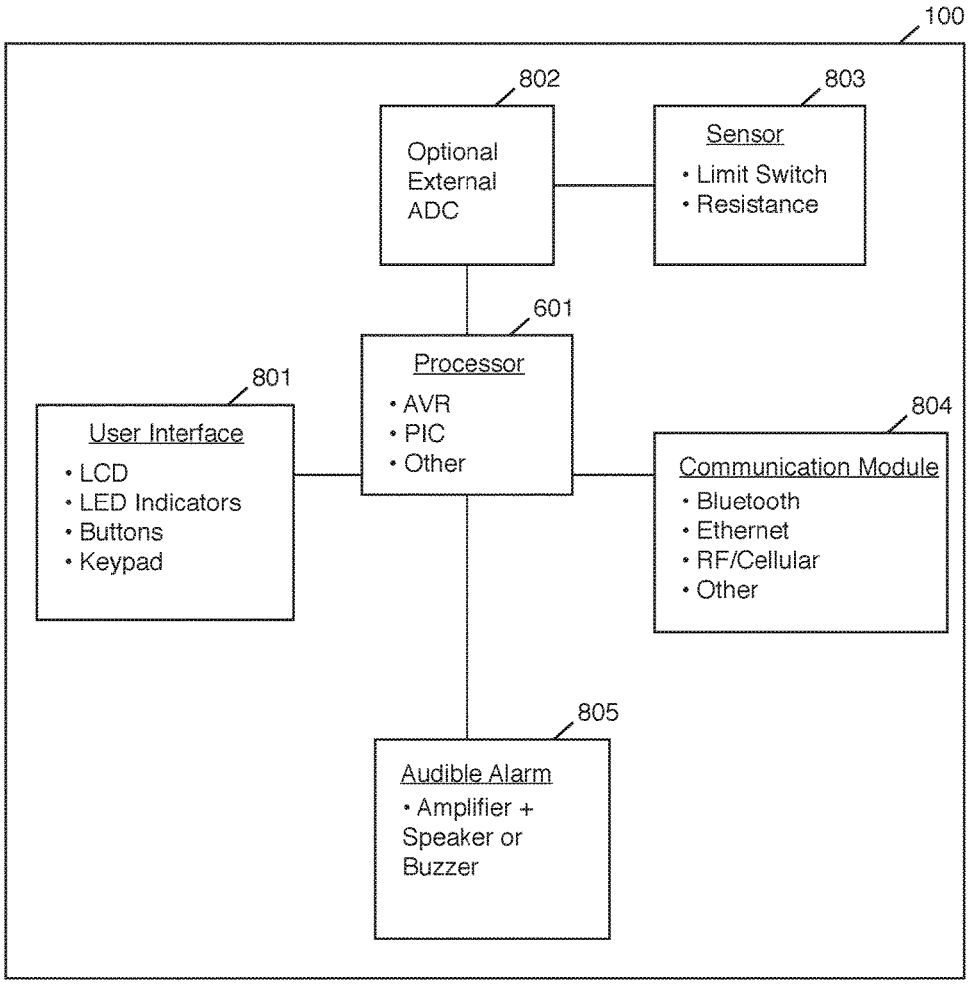

As described herein, the alarm-state indicates the toggling of the firearm monitoring and notification apparatus 100 by a processor unit 601, into a mode where notifications and alarms are provided. As seen in FIG. 8, such notifications and alarms include, but are not limited to: audible alarms, email messages, SMS (short message service), notifications to personal electronic devices, and notifications to local authorities and/or emergency responders. Furthermore, notifications may be sent or received through an application running on a remote computer or personal device, such as a smart-phone. Such communication between the firearm monitoring and notification apparatus 100 and the application may be made through wireless communication protocols, such as—but not limited to—cellular networks, wireless internet connectivity, BLUETOOTH®, ZIGBEE®, or other existing wireless communication protocols appreciated or known to those skilled in the art. The application, connected to the internet may also actuate other smarthome systems such as security systems or lighting systems.

Certain embodiments of the invention, as seen in FIG. 8, of a system surrounding a firearm monitoring and notification apparatus 100, further comprise a processor 601 in the form of a micro-controller, user interface 801, an analog to digital converter 802, a sensor suite 803, a communications module 804 and audible alarm 805. In such an embodiment, the comparator functionality is an embedded capability of the processor 601 to which all electrical signals feed through. Furthermore, it will be appreciated that the processor may be an AVR® chip, a PIC® chip or other similarly capable processor. It will be further appreciated that the communications module 804 comprises some network connectivity such as BLUETOOTH®, IEEE 802.11 wireless transmission, or a mobile phone network.

In certain embodiments, the housing 704, as seen in FIG. 7, comprises a hollow form with a top surface 107. The hollow form allows the installation and containment of all ancillary components, such as system components as shown in FIG. 8, within the volume of the housing 704 and interfacing with the post 102 and cap 103 integrated into the base platform 501.

In certain embodiments, as seen in FIG. 7, a user places a firearm 101 onto a top surface 107 of the firearm monitoring and notification apparatus 100 with a lateral face of the firearm contacting the top surface 107 of the firearm monitoring and notification apparatus 100. The top surface 107 further exhibits an integrated post 102 intended to pass through an aperture 104 defined by the proximal side of the trigger 105 and the proximal end of the trigger guard 106. A constraining element 702 of the firearm monitoring and notification apparatus 100 is then configured to limit the lateral movement of the firearm 101. In certain embodiments, the constraining element 702 is slidably adjustable while engaged with slots 705 in the top surface 107, for the engagement and adjustment of the constraining element 702. A constraining element 702 may be in close proximity to or in contact with one or more surfaces of the firearm 101 including dorsal, ventral or distal surfaces of the firearm 101. A cap 103 is then installed in conjunction with the post 102. The cap 103 is slid down the length of the post 102 until in close proximity or more preferably in contact with an exposed lateral surface of the firearm 101. The cap 103 covers the trigger 105 and trigger guard 106 of the firearm 101 and completes the variable resistance circuit 604, seen in FIG. 6A and FIG. 6B.

In certain embodiments, as shown in FIG. 6A-FIG. 6C and FIG. 8, the closing of a variable resistance circuit 604 electrical signal indicates the presence of the cap 103 over the post 102 of the invention and the position of the cap 103 in relation to the post 102 is recorded as a baseline through a processor 601. The processor 601, is connected to a power supply 602 and a plurality of ancillary components including, but not limited to, notification components such as communications modules 804, audible alarms 805, user interface 801 components and sensor components 803. The processor 601 records the baseline position of the cap 103 and subsequently the firearm monitoring and notification apparatus 100 enters an armed mode. It will be appreciated by those skilled in the art, that such position information may also include position of a cap 103 in relation to sensor components 803 including physical sensors. These sensor components 803 are used to determine movement of the cap 103 from the baseline position, typically resting against the firearm 101, as installed by the user when placing the firearm 101 on the top surface 107 of the firearm monitoring and notification apparatus 100. When in an armed mode, any deviation from this baseline position may indicate the movement or removal of the cap 103. If such an event is detected prior to positive identification of a user, the processor 601 enters an alarm mode and subsequently issuing notifications of audible, visual and/or electronic message.

Certain embodiments, as seen in FIG. 7, comprise push-buttons 701 to allow an authorized user to input a code for positive identification allowing the processor to positively identify a user in order to bypass an alarm mode. When the processor receives input providing positive identification of an authorized user, the firearm monitoring and notification apparatus 100 enters a standby mode, bypassing the armed mode and allowing the cap 103 and then firearm 101 removal without notifications or the firearm monitoring and notification apparatus 100 entering the alarm mode.

It will be appreciated by those skilled in the art that user interface 801 related components, shown in FIG. 8, that allow the input of user-identifying information include, but are not limited to, push-buttons, biometric reading devices and/or other devices allowing the entry of identifying information preset by the user.

Figure 9A:
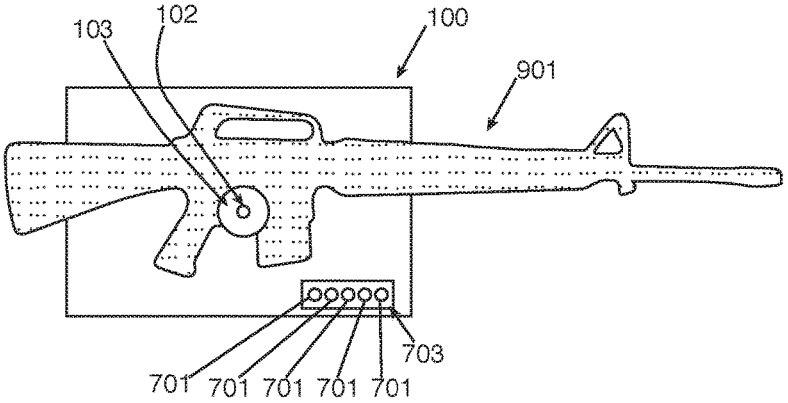
Figure 9B:
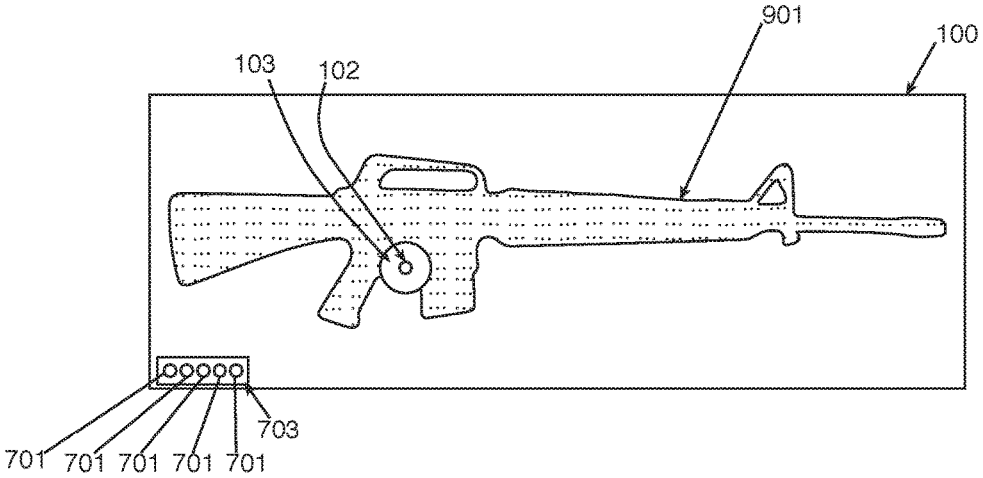

It will be appreciated to those skilled in the art that a firearm monitoring and notification apparatus 100, as shown in FIG. 9A, may be scaled as necessary in various embodiments to allow the use with a firearm 901 of various sizes including, but not limited to pistols, sub-compact firearms, shotguns, rifles and carbines. Some embodiments as demonstrated by FIG. 9B may comprise a larger firearm monitoring and notification apparatus 100 sized to the extents to the intended size of firearm 901. It will be further appreciated that embodiments of the apparatus need not match the size of firearm for which a user may use in conjunction with it.

Figure 10A:
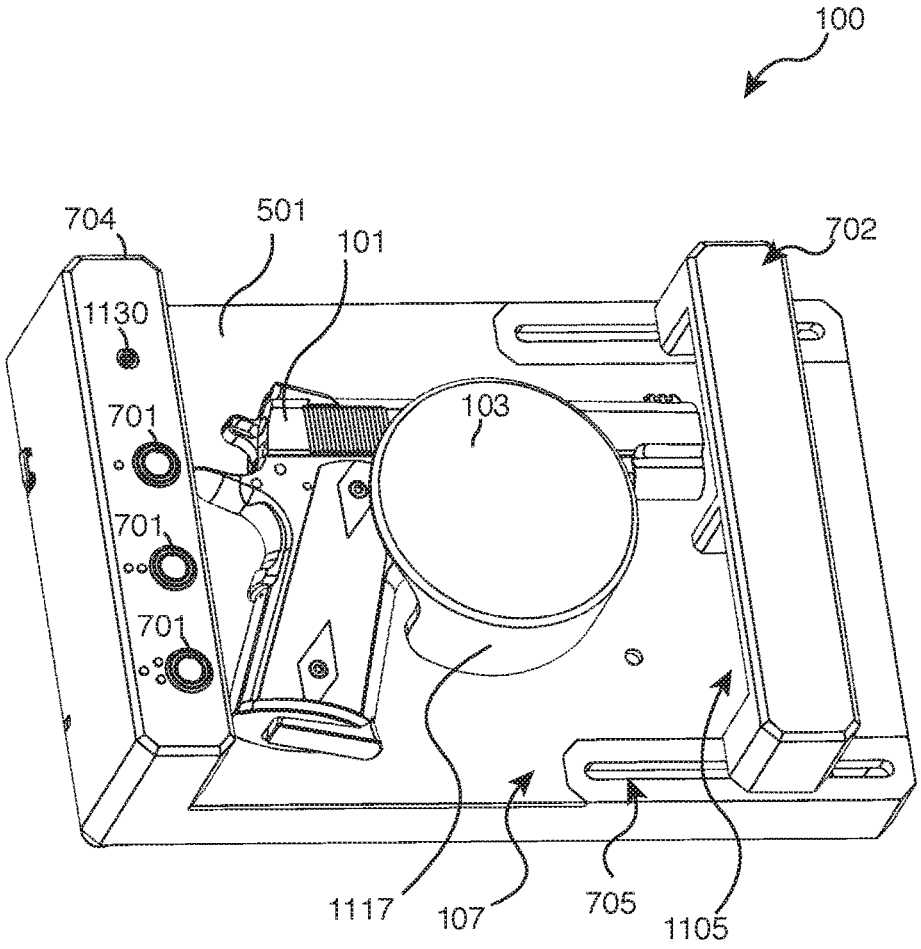
FIG. 10A—A perspective view of an embodiment of a firearm monitoring and notification apparatus.

Certain embodiments of a firearm monitoring and notification apparatus 100 as seen in FIG. 10A comprise a base platform 501, an embodiment of a cap 103, a housing 704, push-buttons 701, an audible alarm device 1130 and a constraining element 702. The base platform 501 further comprises slots 705. The constraining element 702 being slidably attached through the slots 705 allowing custom configuration by the user. The constraining element 702 can be configured such that the distal end of a firearm 101 secured by the firearm monitoring and notification apparatus 100 is disposed at least partially within a recess 1105 of the constraining element 702. In such embodiments, the audible alarm device 1130 comprises a buzzer. However, it will be appreciated that an audible alarm device 1130 may comprise a speaker, a buzzer or any other device known to those skilled in the art to generate an audible signal in association with an electrical signal.

Figure 10B:
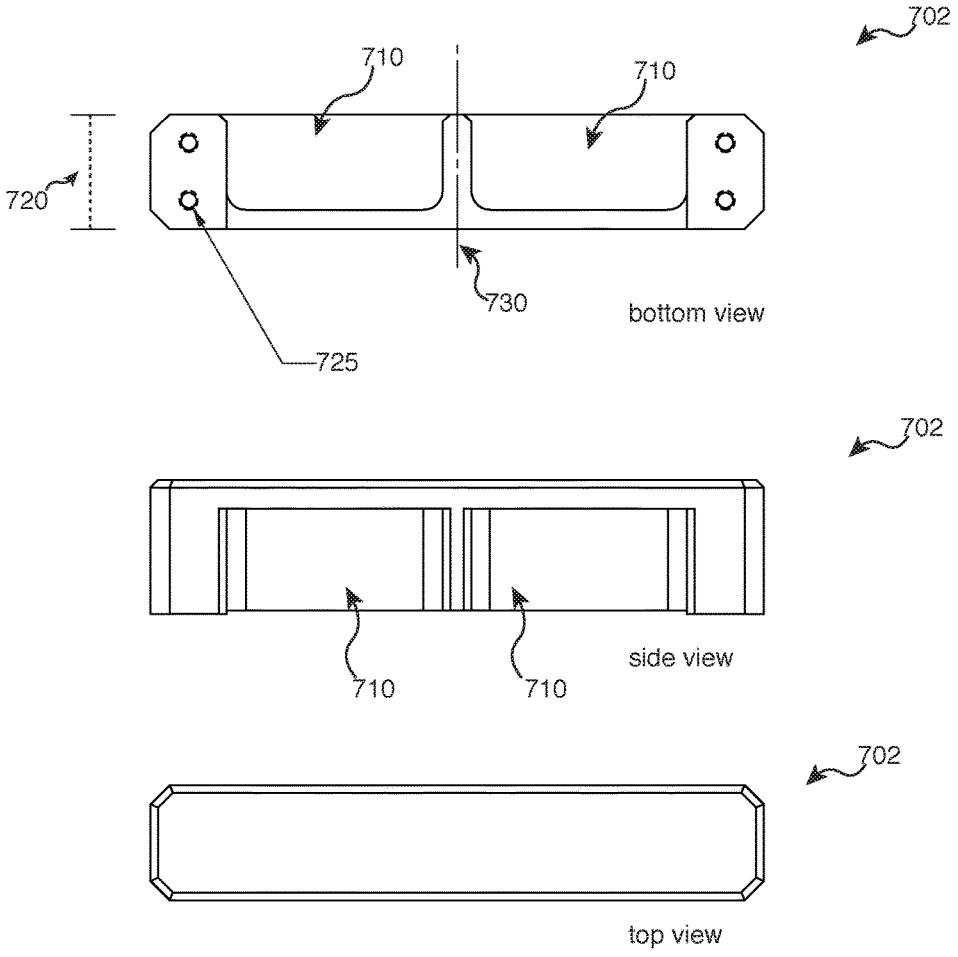
FIG. 10B—Multiple views of an embodiment of a constraining element.

As seen in FIG. 10B, certain embodiments of a constraining element 702 comprise a recess 710 having a recess height 715 of 3.5 cm (1.375 inches) and recess depth 720 of 2.86 cm (1.125 inches) and a recess width of 7.1 cm (2.8 inches). It will be appreciated that a constraining element 702 may comprise a plurality of recesses 710. In certain embodiments a plurality of recesses 710 are separated by a recess partition 730.

Figure 11:
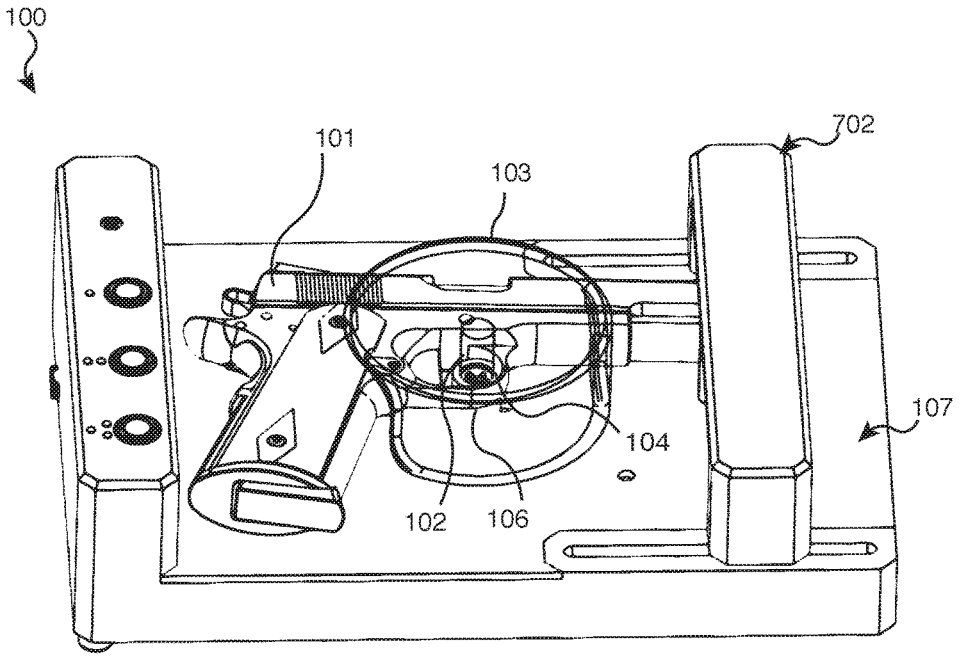
FIG. 11—A perspective view of an embodiment of a firearm monitoring and notification apparatus with transparent cap.
Figure 12:
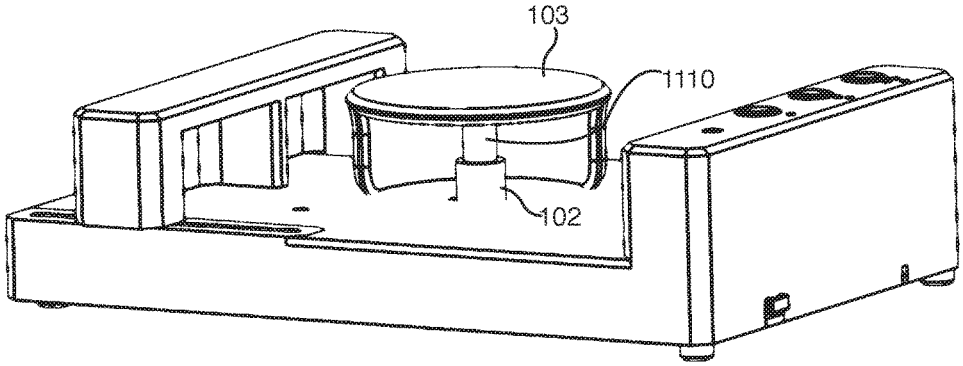
FIG. 12—A perspective view of an embodiment of a firearm monitoring and notification apparatus.

Certain embodiments of a firearm monitoring and notification apparatus 100, as shown in FIG. 11 and FIG. 12, comprise an embodiment of a cap 103 further comprising a pin 1110 element, which is affixed to the cap 103. The pin 1110 engages with an embodiment of a post 102 to secure a firearm 101. It will be appreciated that the length of a post 102 and a pin 1110 need to extend beyond the top surface of the firearm 101 to allow the installation of the cap 103. It will be further appreciated that the length of the post 102 and the length of the pin 1110 may be configured as desired if the total engaged length exceeds the distance between a top surface 107 of the firearm monitoring and notification apparatus 100 and the top of a trigger guard 106.

Figure 13A:
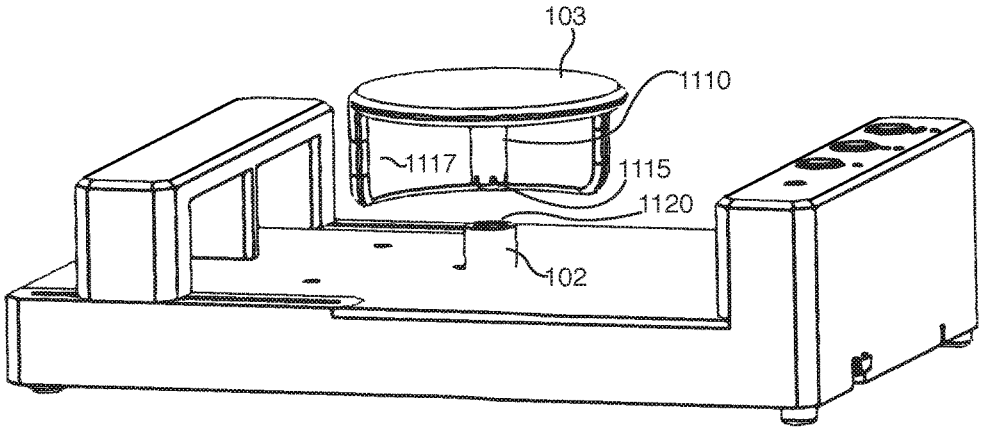
FIG. 13A—A perspective view of an embodiment of a firearm monitoring and notification apparatus with a cap disengaged.
Figure 13B:
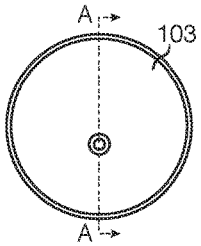
Figure 13C:
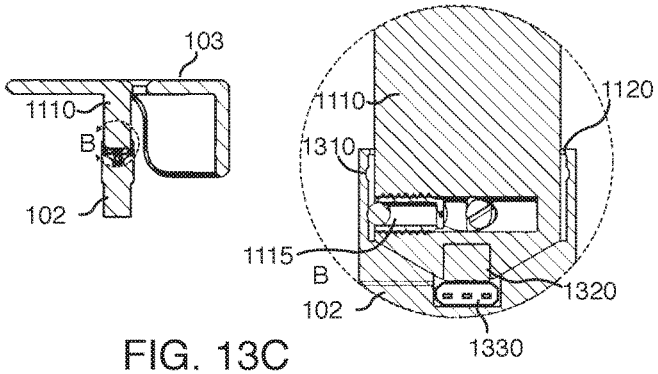
Figure 13D:
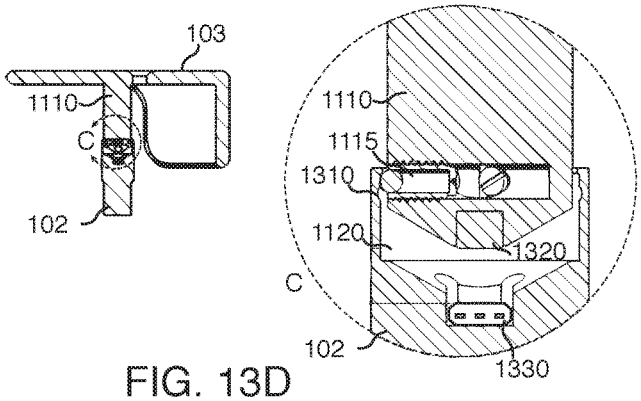
Figure 13E:
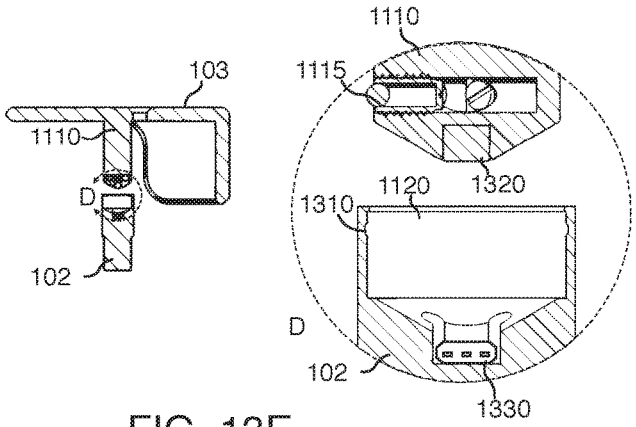

Certain embodiments of a firearm monitoring and notification apparatus 100, seen in FIG. 13A, comprise a cap 103 having a pin 1110. The pin 1110, further comprising a spring detent 1115, mates with the post 102 through the insertion of the pin 1110 into a hole 1120 in the post 102. The spring detent 1115 interfaces with a recess feature 1310 (seen in FIG. 13E) on the internal surface of the hole 1120. Referencing FIG. 13A once again, a cap 103 may further comprise a shroud element 1117 intended to prevent lateral access to the trigger mechanism of a firearm being monitored by the firearm monitoring and notification. The shroud element 1117 comprises a side-wall extending radially around a portion of the cap 103 such that the shroud element 1117 obscures the trigger mechanism of a firearm from sight and physical access. In certain embodiments, shown in FIG. 10A, the shroud element 1117 obscures line-of-sight and physical access to a trigger mechanism of a firearm 101. The shroud element extends downward, terminating proximal to the surface 107 of the base platform.

As seen in in FIG. 13B-FIG. 13E, certain embodiments of a firearm monitoring and notification comprising a cap 103 having a pin 1110 further comprise a plurality of spring detents 1115 for the mating with a post 102 with a hole 1120. In such embodiments, the hole 1120 has a radial recess 1310 with which the spring detents 1115 interface with to provide tensile resistance to retain the cap 103. The pin 1110 further comprises a magnet feature at the distal end, which interacts with a hall effect sensor 1330 that is attached to the base of the hole 1120. The proximity of the magnet 1320 to the hall effect sensor 1330 completes a connection to provide an electrical signal that is used by a processor to identify the presence of the cap 103. In certain embodiments, the magnet 1320 can be pulled axially away from the hall effect sensor 1330 prior to the disengagement of the ball detents 1115 from the radial recess 1310. Such embodiments indicate the potential removal of the cap 103 prior to the disengagement of the pin 1110 from the post 102. The potential removal of the cap 103 may be used as basis to alert a user or initiate an audible alarm associated with a change in status of the magnet 1320 in relation to the hall effect sensor 1330 initiate an audible alarm.

In such embodiments, the cap 103 has a pin 1110, and the post 102 has a hole 1120. The interface between the cap 103 and the post 102 relies on the mating of the pin 1110 with the hole 1120.

Certain embodiments of a firearm monitoring and notification apparatus, as seen in FIG. 11, comprise a breakaway feature surrounding the interface between a cap 103 and a post 102. A breakaway feature is configured to prevent the unauthorized or unintentional discharge of a firearm secured by the firearm monitoring and notification apparatus. It will be appreciated that an unauthorized or unintentional discharge may occur when a pin 1110 or post 102 is in contact with the distal side of a trigger 105 and the firearm is moved in a distal direction. In embodiments comprising a breakaway feature, the length of the post 102 and the pin 1110 are configured such that the pin 1110 contacts the distal side of the trigger 105. In this configuration, if the firearm 101 is moved in the distal direction the pin 1110 disengages from the post 102 prior to actuation of the trigger 105. It will be appreciated that a breakaway feature must disengage from the post 102 when a lateral force is applied to the pin 1110. It will be further appreciated that this force cannot be in excess of the force required to actuate the trigger 105. It will be appreciated to those skilled in the art that a breakaway feature may comprise any attachment feature with a release force that is predetermined and repeatable.

Figure 14A:
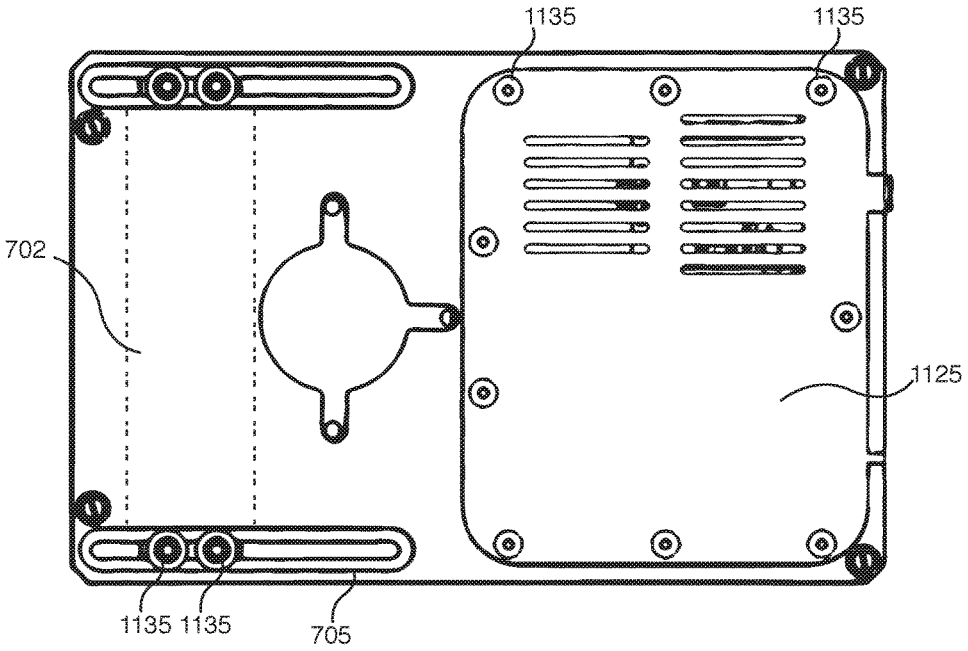
FIG. 14A—A bottom view of an embodiment of a firearm monitoring and notification apparatus.
Figure 14B:
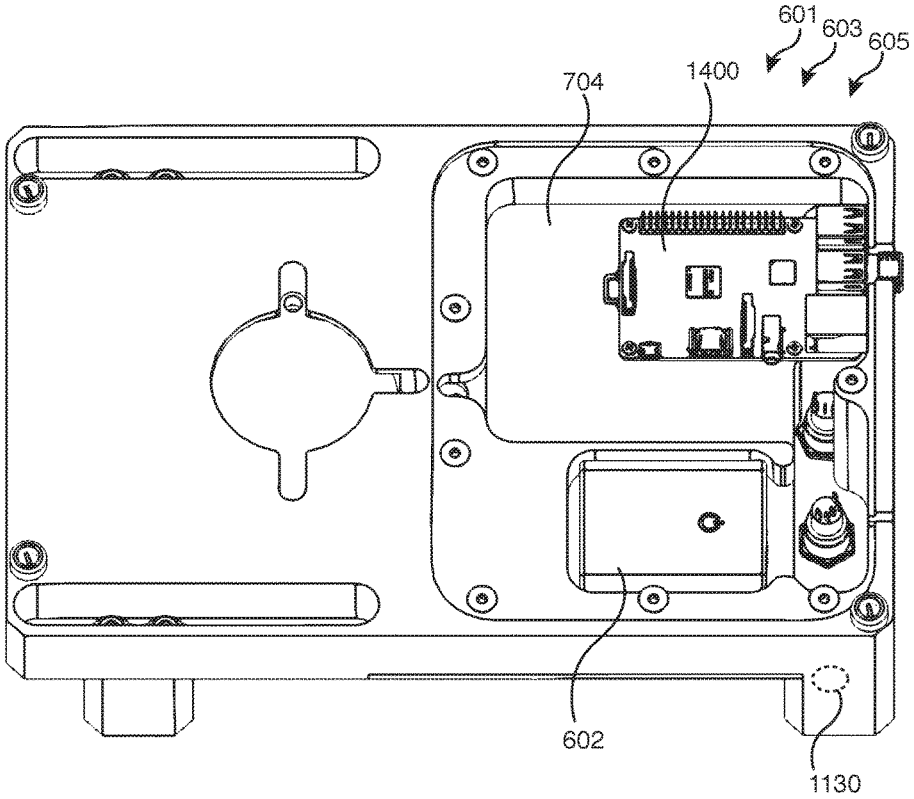

As seen in FIG. 14A and FIG. 14B, certain embodiments of a firearm monitoring and notification apparatus 100 comprise fasteners 1135 for the constraint of a constraining element 702. The fasteners 1135 engaged through slots 705 on a bottom planar face of the firearm monitoring and notification apparatus 100 to engage and affix the constraining element 702. The firearm monitoring and notification apparatus 100 further comprises an electrical component door 1125 on the bottom planar surface of the firearm monitoring and notification apparatus 100. Fasteners 1135 constrain the component door 1125 to the firearm monitoring and notification apparatus 100. Concealed by the component door 1125, is access to a housing 704 containing ancillary components. In certain embodiments, ancillary components comprise a power supply 602 and a circuit board 1400, which comprises a processor 601, a comparator 603 and a notification system 605. It will be appreciated that a circuit board 1400 may comprise custom circuitry known to those skilled in the art or pre-manufactured circuitry as found with a Raspberry Pi® or Arduino®. It will be further appreciated that a circuit board 1400 may have integrated wireless communication protocol capability or plug-and-play wireless communication modules such as for WI-FI® or BLUETOOTH®. In certain embodiments, the present invention communicates with or is able to integrate with existing smart-home systems, or devices associated with an IoT system. Through the communication through an IoT, the notification system 605 can actuate other IoT connected systems such as lighting, home security alarms, and surveillance systems.

Figure 15:
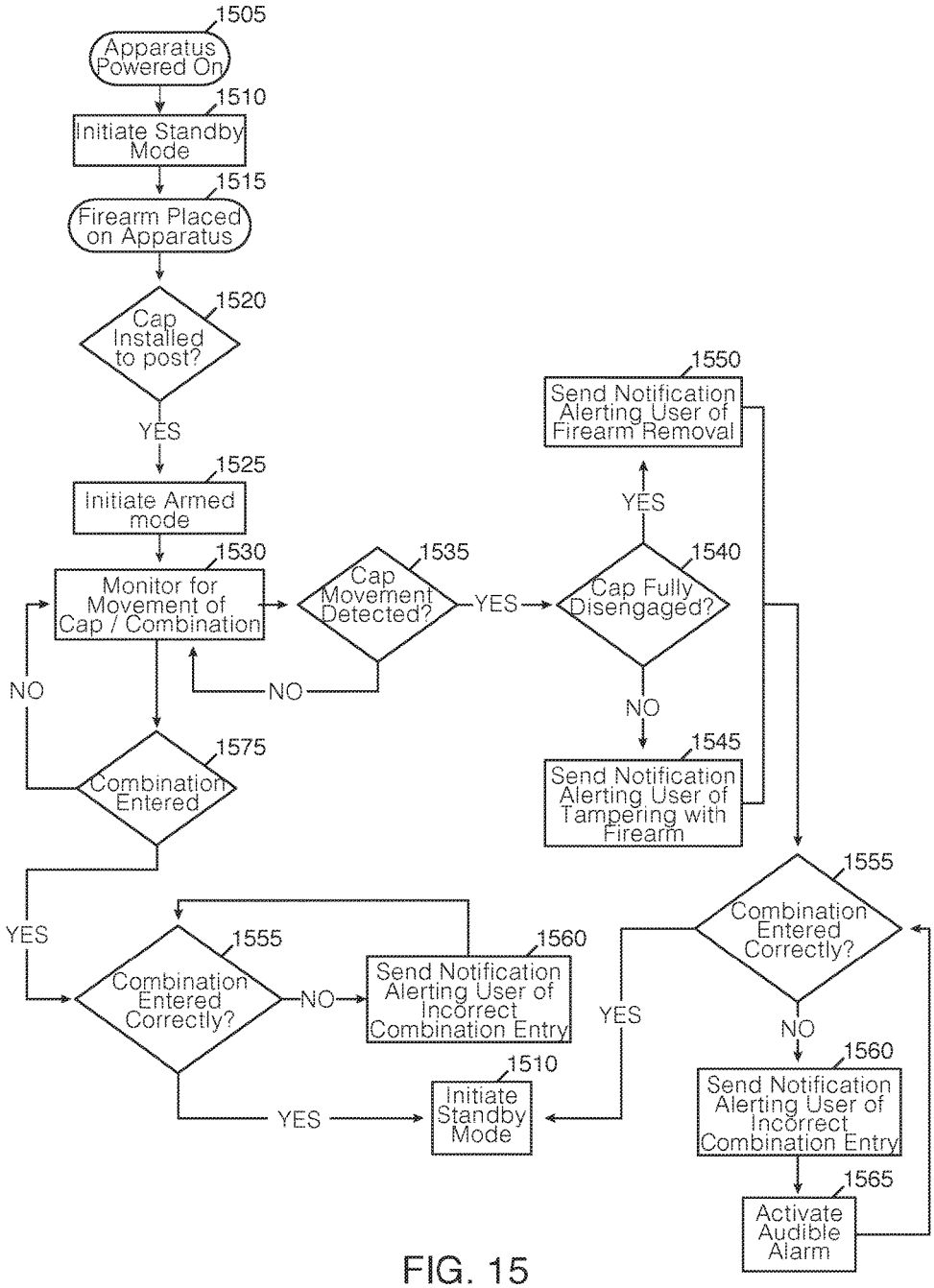
FIG. 15—An embodiment of a method for the monitoring of a firearm and generating notifications.

In certain embodiments, as seen in FIG. 15, a firearm monitoring and notification apparatus is used to secure a firearm using steps comprising, powering on the apparatus 1505, which initiates the apparatus entering a stand-by mode 1510. After entering standby mode 1515, the apparatus continually checks for the installation of a cap 1520. If a cap is not installed, the unit continues to monitor for the installation of a cap. A user may then place a firearm on the apparatus with a post extending through a portion of the trigger-guard. The user then installs a cap to the post. Once a cap is installed, the apparatus senses the installation of the cap and initiates an "armed mode 1525." Once the "armed mode" is initiated 1525, the apparatus monitoring for movement of the cap or an entered combination 1530 and determines if cap movement is detected 1535. If movement of the cap is not detected and a combination is not entered, the apparatus continues monitor for the movement of the cap or entry of a combination 1530. When movement of the cap is detected, the apparatus determines if the cap is fully engaged or not fully engaged 1540. If the cap has not been fully disengaged, the apparatus sends notification alerting the user to tampering with the firearm 1545. If the cap has been fully disengaged, the apparatus sends notification alerting the user to the removal of the firearm 1550. At this point a user may enter a combination in a predetermined length of time and the apparatus determines if it is the preprogrammed combination 1555. If the preprogrammed combination is entered, the apparatus initiates the standby mode 1510. If the preprogrammed combination is not entered in the predetermined period of time, the apparatus sends notification alerting the user of an incorrect combination entry 1560 and activates an audible alarm 1565 until the preprogrammed combination is entered.

In certain embodiments, as seen in FIG. 15, it will be appreciated that a user may enter a combination at any point after the step comprising the initiation of the armed mode 1525. In such scenarios the apparatus detects if a combination is entered 1575, and further determines if the combination entered is the preprogrammed combination 1555. If the entered combination is not the preprogrammed combination the apparatus sends notification alerting the user of incorrect combination entry 1560. If the combination entered is the preprogrammed combination, the apparatus initiates the standby mode 1510. It will be further appreciated that if an incorrect combination is entered at any point after the apparatus initiates the armed mode, a notification may be sent to the user alerting them to an incorrect code being entered.

In certain embodiments of an apparatus, the step comprising the activation of an audible alarm may further comprise the audible alarm terminating after a predetermined length of time.

It will be further appreciated to those skilled in the art that the use of the firearm monitoring and notification apparatus comprising monitoring and notification systems is not limited to the monitoring and notification surrounding firearms. The technology as disclosed herein may be used for the monitoring and notification surrounding the access to any object for which an authorized user or owner desires to have such monitoring and notification.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "top," "bottom," etc., as used herein, are intended for illustrative purposes only and do not limit the embodiments in any way. Additionally, the term "plurality," as used herein, indicates any number greater than one, either disjunctively or conjunctively, as necessary, up to an infinite number. Further, "Providing" an article or apparatus, as used herein, refers broadly to making the article available or accessible for future actions to be performed on the article, and does not connote that the party providing the article has manufactured, produced, or supplied the article or that the party providing the article has ownership or control of the article. Accordingly, while specific embodiments have been illustrated and described, numerous modifications come to mind without significantly departing from the spirit of the invention and the scope of protection is only limited by the scope of the accompanying claims.

What is claimed is:

1. A firearm monitoring and notification apparatus comprising:

a base platform comprising a surface, a post protruding from the surface of the base platform;

a cap which is matable with the post;

a power supply having electrical connection to the post;

a comparator having electrical connection to the cap and the post, wherein the comparator senses a change in configuration of mating between the cap and post.

2. The firearm monitoring and notification apparatus of claim 1, wherein the post comprises a sensor affixed to the post;

and the cap comprises a magnet affixed to the cap, wherein movement of the cap in relation to the post is communicated by the sensor to the comparator.

3. The firearm monitoring and notification apparatus of claim 1, wherein the sensor comprises a hall effect sensor.

4. The firearm monitoring and notification apparatus of claim 1, wherein the cap further comprises a pin; and the post comprises a hole, wherein the cap is matable with the post through the mating of the pin with the hole.

5. The firearm monitoring and notification apparatus of claim 4, wherein the pin comprises a spring detent at a distal end of the pin; and the hole comprises a radial recess feature, wherein the spring detent indexes within the radial recess feature when the pin is mated with the hole.

6. The firearm monitoring and notification apparatus of claim 1, wherein the cap comprises a shroud element.

7. The firearm monitoring and notification apparatus of claim 6, wherein the shroud element comprises a side-wall extending radially around a portion of the cap; and the shroud element extends downward terminating proximal to the surface of the base platform.

8. The firearm monitoring and notification apparatus of claim 1, further comprising a processor having electrical connection to the comparator.

9. The firearm monitoring and notification apparatus of claim 8, wherein the base platform further comprises a user interface panel comprising push-buttons; and the push-buttons having electrical connection to the processor.

10. The firearm monitoring and notification apparatus of claim 1, further comprising an audible alarm having electrical connection to the comparator.

11. The firearm monitoring and notification apparatus of claim 1, comprising a constraining element extending away from the surface of the base platform;

the constraining element comprising a recess, wherein the recess is configured to receive a portion of a distal end of a firearm disposed on the surface of the base platform.

12. The firearm monitoring and notification apparatus of claim 11, wherein the constraining element is slidably connected to the base platform.

13. The firearm monitoring and notification apparatus of claim 1, further comprising a communications module comprising wireless communication capability.

14. The firearm monitoring and notification apparatus of claim 13, wherein the communications module further comprises BLUETOOTH® communication protocol capability.

15. The firearm monitoring and notification apparatus of claim 13, wherein the communications module further comprises IEEE 802.11 wireless communication protocol capability.

16. The firearm monitoring and notification apparatus of claim 1, wherein the post is configured to allow for disposal of an aperture of the firearm over the post.

* * * * *